US005335709A

United States Patent [19]

Borzi

[11] Patent Number: 5,335,709

[45] Date of Patent: Aug. 9, 1994

[54] PELMET SUPPORT STRUCTURE WHICH PROVIDES FOR LONGITUDINAL ADJUSTMENT

[76] Inventor: Enzo Borzi, via C. Ferrini, 12, Rome, Italy, 00173

[21] Appl. No.: 983,587

[22] PCT Filed: Nov. 26, 1991

[86] PCT No.: PCT/IT91/00101

§ 371 Date: Feb. 4, 1993

§ 102(e) Date: Feb. 4, 1993

[87] PCT Pub. No.: WO93/00034

PCT Pub. Date: Jan. 7, 1993

[30] Foreign Application Priority Data

Jun. 24, 1991 [IT] Italy ..... RM 91 A 000454

[51] Int. Cl.[5] ..... E06B 9/00

[52] U.S. Cl. ..... 160/39

[58] Field of Search ..... 160/39, 38, 19, 21, 160/23.1, 29

[56] References Cited

U.S. PATENT DOCUMENTS

| | | | |
|---|---|---|---|
| 2,708,711 | 5/1955 | McGinity et al. | 160/19 X |
| 2,998,062 | 8/1961 | Bixby . | |
| 3,463,217 | 8/1969 | Assael | 160/39 |
| 3,574,887 | 4/1971 | Schindlauer | 160/19 X |
| 4,079,770 | 3/1978 | Woodle | 160/39 X |
| 4,903,394 | 2/1990 | Roberts . | |
| 5,042,548 | 8/1991 | Attal | 160/38 |

FOREIGN PATENT DOCUMENTS

| | | |
|---|---|---|
| 1151907 | 7/1963 | Fed. Rep. of Germany . |
| 2244434 | 4/1975 | France . |

*Primary Examiner*—David M. Purol

*Attorney, Agent, or Firm*—Beveridge, DeGrandi, Weilacher & Young

[57] ABSTRACT

The pelmet according to the present invention includes a central right element and two end parts, connected such that longitudinal adjustment may be obtained via the telescopic sliding of the end portions of the central element in guides provided in the end part.

5 Claims, 1 Drawing Sheet

PELMET SUPPORT STRUCTURE WHICH PROVIDES FOR LONGITUDINAL ADJUSTMENT

BACKGROUND OF THE INVENTION

The present invention relates to a device that allows the longitudinal adjustment of a pelmet corresponding to the width of a window or other object. The pelmet according to the invention includes a central element and two end parts.

It is already known that pelmets are commonly used support structures for curtains, from an aesthetic and functional point of view, but that they require for their installation, the skill of specialized people for tailoring the dimensional attributes of the pelmet to its chosen placement.

It is an objective of the present invention to provide a pelmet with a simple and functional adjusting means so as to allow the mounting of the pelmet in different placements according to the wishes of the users and without the assistance of specialized persons.

SUMMARY OF THE INVENTION

The objective set forth is achieved by means of the device according to the present invention, wherein the pelmet includes a central element and two end parts, connected by adjustable means that may be obtained by the telescopic sliding of the end portions of the central element within back guides in the end parts.

The advantages of the device according to the present invention are:

the pelmet may be mounted by unskilled persons;

the central element may be adapted for being covered by tapestry cloth, paper, or other covering to provide an aesthetic effect;

Because it is envisioned that the inventive pelmet will be covered with tapestry or other covering, the elements which make up the device may be selected from inexpensive materials such as plastic, polyurethane, metal or similar materials, thus lowering production costs.

The present invention will be described more in detail hereinbelow according to the enclosed drawings, in which a preferred embodiment is shown.

Figure 1:
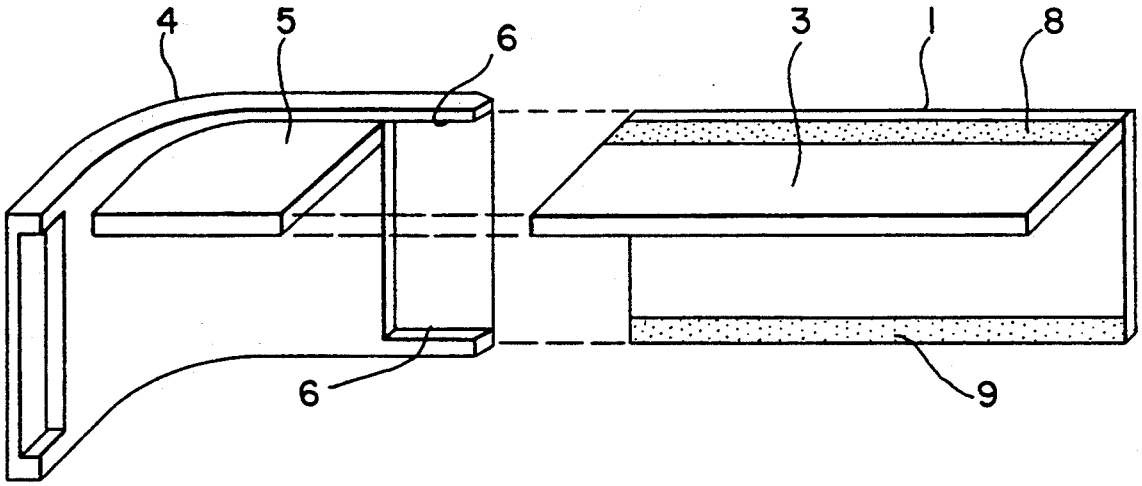
FIG. 1 shows a perspective and an exploded back view of a pelmet.
Figure 2:
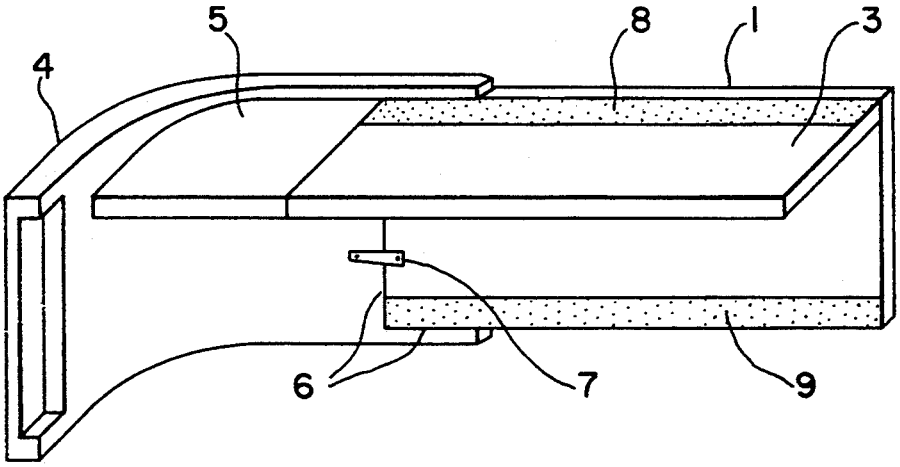
FIG. 2 shows a mounted pelmet with the longitudinal adjusting device.
Figure 3:
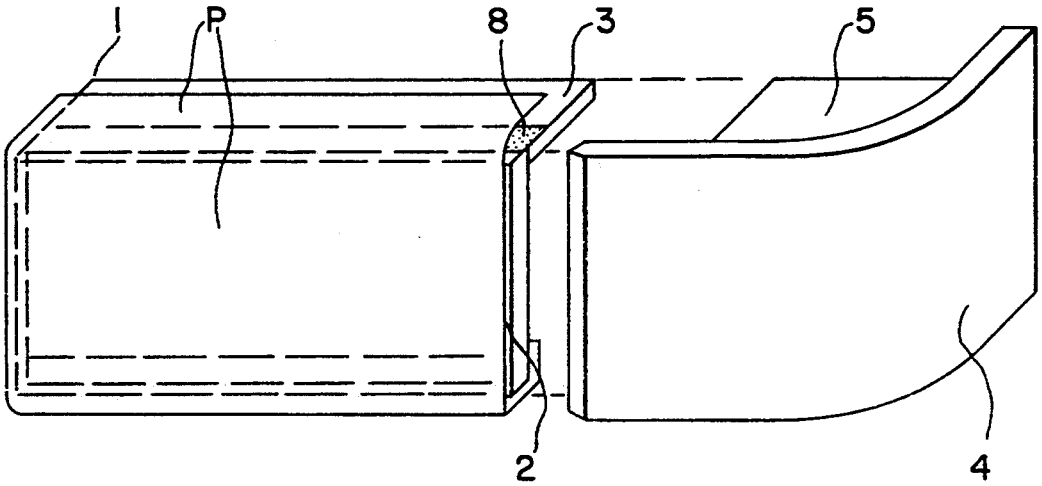
FIG. 3 shows a perspective and an exploded view of the covering of the elements of the pelmets by tapestries like cloth, paper or similar material.

DETAILED DESCRIPTION OF THE PREFERRED EMBODIMENT:

The figures show a device which allows for the longitudinal adjustment of a pelmet corresponding to the width of the windows or other objects, wherein the pelmet comprises a central element and two end parts, characterized by:

a central element 1 with an outer face 2 and an upper orthogonal side 3 made of polyurethane or other suitable material;

two end parts (of which only one is shown) with an outer curved surface 4, upper orthogonal side 5 and back guide 6 which accepts the end portions of the central element and provides for telescopic sliding adapted for adjustment so as to allow for the longitudinal adaptation of the pelmet to different width placements;

a connecting means 7, utilizing a screw, pins, adhesive or similar means, to secure the end part 4 to the central element 1.

In possible variants of the present invention, the end parts 4 with curved surfaces may be replaced with conventional ends having right angles, but provided with a back guide 6 for the telescopic sliding to allow for the longitudinal adjustment of the central element 1.

Furthermore, according to the present invention, central element 1 is provided with adhesive bands 8 and 9 for adhering a tapestry or similar covering to the outer surface of the structure.

What is claimed is:

1. A pelmet support structure which is adapted for longitudinal adjustment, comprising:

a central element having end portions and a frontal surface, said central element having adhesive means provided along its length;

two end parts each having a front portion and a side portion substantially perpendicular to said front portion, wherein each of said front portions are adapted to adjustably secure said central element; and connecting means for securing said central element to said end parts; wherein, said front portion of said end parts each include an outer surface and an inner surface opposite said outer surface wherein said inner surface includes a back guide which is adapted to receive one end portion of said central element, said back guide being further adapted to allow for adjustment of said central element within said back guide so as to allow for the longitudinal adjustment of said pelmet support structure.

2. The pelmet support structure as claimed in claim 1, wherein said end parts further include an upper orthogonal portion extending across an upper portion of said end part.

3. The pelmet support structure as claimed in claim 1, wherein said central portion further includes an upper orthogonal portion extending back from an upper portion of said central element.

4. The pelmet support structure as claimed in claim 1, wherein said front portion and said side portion of said end parts are connected by a curved portion.

5. The pelmet support structure as claimed in claim 1, wherein said front portion and said side portion of said end parts are connected at a right angle.

* * * * *